US012365436B1

(12) United States Patent
Kirchhoff et al.

(10) Patent No.: US 12,365,436 B1
(45) Date of Patent: Jul. 22, 2025

(54) MARINE STEERING SYSTEMS AND STEERING CONTROL METHODS

(71) Applicant: Brunswick Corporation, Mettawa, IL (US)

(72) Inventors: Thomas S. Kirchhoff, Waupaca, WI (US); Jason S. Arbuckle, Horicon, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/731,992

(22) Filed: Jun. 3, 2024

Related U.S. Application Data

(63) Continuation of application No. 17/146,786, filed on Jan. 12, 2021, now Pat. No. 12,030,607.

(51) Int. Cl.

| | |
|---|---|
| ***B63H 20/12*** | (2006.01) |
| ***B63B 79/10*** | (2020.01) |
| ***B63B 79/40*** | (2020.01) |
| ***B63H 20/00*** | (2006.01) |
| ***B63H 25/42*** | (2006.01) |

(52) U.S. Cl.
CPC ..... *B63H 20/12* (2013.01); *B63B 79/10* (2020.01); *B63B 79/40* (2020.01); *B63H 25/42* (2013.01); *B63H 2020/003* (2013.01)

(58) Field of Classification Search
CPC .. B63H 20/12; B63H 25/42; B63H 2020/003; B63B 79/10; B63B 79/40
See application file for complete search history.

(56) References Cited

U.S. PATENT DOCUMENTS

| | | | |
|---|---|---|---|
| 6,913,497 | B1 | 7/2005 | Ahiswede et al. |
| 7,467,595 | B1 | 12/2008 | Lanyi et al. |
| 7,941,253 | B1 | 5/2011 | Brant |
| 8,113,892 | B1 | 2/2012 | Gable et al. |
| 9,132,903 | B1 | 9/2015 | Gable et al. |
| 9,248,898 | B1 | 2/2016 | Kirchhoff et al. |
| 9,290,252 | B1 | 3/2016 | Tuchscherer et al. |
| 9,359,057 | B1 | 6/2016 | Andrasko et al. |
| 9,908,606 | B1 | 3/2018 | Andrasko et al. |
| 10,196,122 | B1 | 2/2019 | Andrasko et al. |
| 10,562,602 | B1 | 2/2020 | Gable et al. |
| 10,703,456 | B1 | 7/2020 | Andrasko et al. |
| 10,800,502 | B1 | 10/2020 | Uppgard et al. |
| 11,370,521 | B1 | 6/2022 | Arbuckle et al. |
| 2009/0171520 | A1 | 7/2009 | Kaji |
| 2011/0106347 | A1 | 5/2011 | Itoi et al. |

*Primary Examiner* — Michael J Zanelli
(74) *Attorney, Agent, or Firm* — Andrus Intellectual Property Law, LLP

(57) ABSTRACT

A method of operating a steering system for a marine vessel includes controlling a resistance device to apply a resistance force against rotation of the steering wheel in a first rotational direction past an end stop position, controlling a steering actuator associated with a marine drive based on a steering map and such that a drive angle of the marine drive stays within a permitted drive angle range, and determining that the current wheel position has passed the end stop position and then adjusting control of the steering actuator to account for the current wheel position being past the end stop position.

20 Claims, 7 Drawing Sheets

MARINE STEERING SYSTEMS AND STEERING CONTROL METHODS

CROSS-REFERENCE TO RELATED APPLICATION

This application is a continuation of U.S. patent application Ser. No. 17/146,786, filed Jan. 12, 2021, the contents of which is hereby incorporated by reference in its entirety.

FIELD

The present disclosure generally relates to steering systems and methods for marine vessels, and more particularly to systems and methods for adaptive steering of marine drives to provide responsive and safe steering control of marine vessels.

BACKGROUND

The following U.S. Patents and Patent Applications provide background information and are incorporated by reference in entirety.

U.S. Pat. No. 7,941,253 discloses a marine propulsion drive-by-wire control system controlling multiple marine engines, each one or more PCMs, propulsion control modules for controlling engine functions which may include steering or vessel vectoring. A helm has multiple ECUs, electronic control units, for controlling the multiple marine engines. A CAN, controller area network, bus connects the ECUs and PCMs with multiple PCM and ECU buses. The ECU buses are connected through respective isolation circuits isolating the respective ECU bus from spurious signals in another ECU bus.

U.S. Pat. No. 8,113,892 discloses a marine propulsion control system receiving manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 10,196,122 discloses a method of operating a steer-by-wire steering system on a marine vessel including receiving an initial component position of a steerable component and receiving an initial wheel position of a manually rotatable steering wheel with respect to a zero position. An initial normalized steering value is then calculated based on the initial component position, and the initial normalized steering value is correlated to the initial wheel position. The correlation between a subsequently received wheel position and a subsequently calculated normalized steering value is then adjusted by a recovery gain until the steering wheel reaches an aligned position with the steerable component.

U.S. Pat. No. 10,703,456 discloses a drive-by-wire control system for steering a propulsion device on a marine vessel including a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

U.S. patent application Ser. No. 17/068,332 discloses a method for aligning steering angles of marine propulsion devices. The method includes receiving a first steering request to steer the marine propulsion devices, where when the first steering request is received, steering for a first device is deactivated and steering for a second device is activated, and changing a steering angle of the second device according to the first steering request while leaving a steering angle of the first device unchanged. The method includes receiving a request to activate steering for the first device and receiving a second steering request, then changing the steering angles of both the first and second devices when the second steering request is received after receiving the request to activate steering, and changing the steering angle of the second device while leaving the steering angle for the first device unchanged when the second steering request is received before receiving the request to activate steering.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of operating a steering system on a marine vessel includes changing a maximum drive angle defining a permitted drive angle range for at least one marine drive and then, based on a steering map correlating wheel positions of a manually rotatable steering wheel to drive angles of the marine drive, adjusting at least one end stop wheel position to an adjusted end stop wheel position based on the changed maximum drive angle. Once it is determined that a current wheel position of the steering wheel is approaching the adjusted end stop wheel position, a resistance device is controlled to apply a resistance force against rotation of the steering wheel in a first rotational direction past the end stop position. The steering actuator associated with the marine drive is then controlled based on the steering map such that a drive angle of the marine drive stays within the permitted drive angle range.

One embodiment of a steering system configured for steering a marine vessel includes at least one marine drive, at least one steering actuator configured to rotate the at least one marine drive about a vertical steering axis, a steering wheel configured to be manually rotated by an operator to be able to adjust a drive angle of the marine drive effectuated by the steering actuator, a wheel position sensor configured to sense a position of the steering wheel, and a resistance device configured to apply a resistance force to resist rotation of the steering wheel. A control system is configured to change a maximum drive angle defining a narrowed permitted drive angle range for the at least one marine drive and then, based on a steering map correlation wheel positions of the manually rotatable steering wheel to drive angles of the marine drive, at least one end step wheel position is adjusted to an adjusted end stop wheel position based on the changed maximum drive angle. Once a current wheel position measured by the wheel position sensor is approaching the adjusted end stop position, a resistance device is controlled to resist rotation of the steering wheel in a first rotational direction past the adjusted end stop position.

One embodiment of the method of operating a steering system on a marine vessel includes changing a maximum drive angle defining a permitted driving angle range for the at least one marine drive and then adjusting a steering map correlating wheel positions of a manually rotatable steering wheel to drive angles of the marine drive based on the changed maximum drive angle and the corresponding permitted drive angle range. The steering actuator for the marine drive is then controlled based on the adjusted steering map such that a drive angle of the marine drive stays within the permitted drive angle range.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

Figure 1:
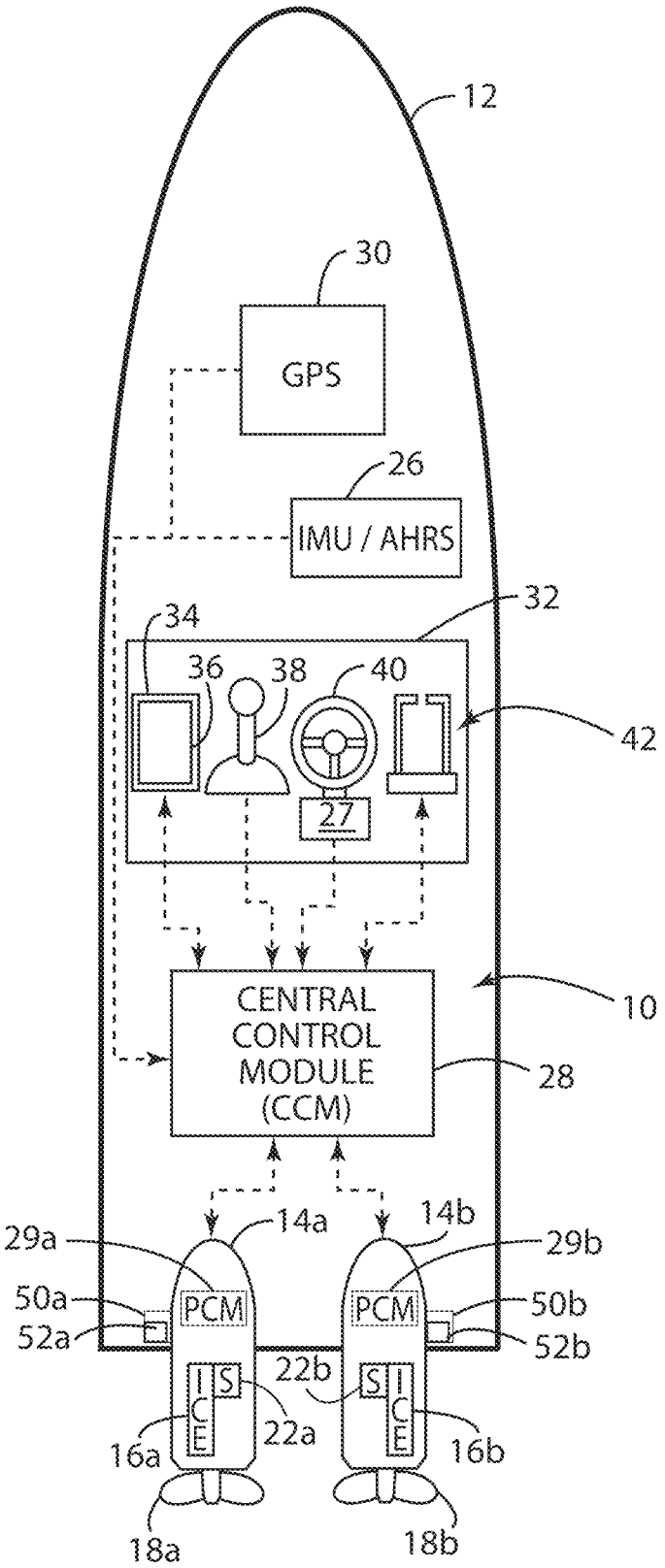
FIG. 1 is a top view of an exemplary marine vessel having a steering system in accordance with one embodiment of the present disclosure.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

The present inventors have recognized that in certain situations it is necessary to change the permitted drive angle range, or the angles at which a marine drive is permitted to travel, such as to reduce the maximum angles that a drive can be steered to. Narrowing the permitted drive angle range may be required, for example, to prevent closely mounted marine drives from hitting each other. The present inventors have recognized that the mounting distance between marine drives has decreased on modern vessels as the number of marine drives being mounted on the marine vessel increases and as the marine drives become larger. Further, drive configurations, such as dual propeller configurations, may extend the overall length of the marine drive being steered, thereby increasing the possibility of collision between adjacent marine drives. Other situations may also require narrowing the permitted drive angle range, such as high-speed steering conditions or other steering conditions where limiting the maximum angle to which the marine drive can be rotated may be favorable and/or required.

In view of the foregoing needs in the relevant art recognized by the inventors, as well as in view of their extensive experimentation and research in the relevant field, the disclosed steering system and operating method were devised to provide an adaptive steering system that adapts control correlation between the steering wheel and the marine drives to enable changing a maximum drive angle and a permitted drive angle range for at least one marine drive on a marine vessel. In one embodiment, once a maximum drive angle defining a permitted drive angle range for at least one marine drive is changed, at least one end stop wheel position is adjusted to an adjusted end stop wheel position based on the changed maximum drive angle. When a measured wheel position of the steering wheel approaches the adjusted end stop position, a resistance device is controlled to apply a resistance force against rotation of the steering wheel to discourage or prevent the steering wheel from being rotated past the adjusted end stop position. If the steering wheel is moved past the adjusted end stop position, a maximum resistance force against continued rotation of the steering wheel past the adjusted end stop position is applied. This discourages or prevents continued rotation of the steering wheel further past the adjusted end stop position.

The inventors have recognized that when the end stop is not effective and the steering wheel is moved past the end stop position, a situation occurs where the steering wheel position no longer associated with a drive angle that is within the permitted drive angle range. When the steering wheel is turned past the adjusted end stop position, the drive angle of the marine drive is not steered past the maximum drive angle and is instead controlled such that the marine drive stays within the permitted drive angle range. This leads to a situation where the steering system is not responsive to the user inputs of the steering wheel—i.e., where no corresponding movement of the marine drive is effectuated when the steering wheel is moved in either direction. This can be frustrating and confusing for the user. Further, such non-responsiveness may lead to a dangerous situation in an emergency where an operator is trying to quickly steer the marine vessel, such as away from an obstacle.

In view of the foregoing, aspects of the disclosed system and method were developed such that, once the steering wheel is turned past the end stop, the steering map is shifted accordingly in order to provide a steering response once the wheel is turned back the other way. The steering map correlates the measured wheel position to a drive angle within the permitted drive angle range. Thereby, the user is enabled to continually steer the marine vessel so long as the marine drives remain within the drive angle range by changing the steering map when the operator rotates the steering wheel past the adjusted end stop wheel position. This includes changing wheel position that is correlated with a centered drive position and thus steering wheels with a preferred center wheel position may appear misaligned. Such misalignment can be corrected, for example, by steering alignment recovery methods. Exemplary steering alignment recovery methods are shown in disclosed, for example, in U.S. Pat. No. 10,196,122 incorporated herein by reference in its entirety.

In other embodiments, instead of adjusting the end stop positions, the steering map may be adjusted such that the range of wheel positions between end stops is remapped to the range of angles within the changed permitted drive angle range. In such an embodiment, the center wheel position that is correlated with the centered drive position may be unchanged (where the drive effectuates a propulsion that is perpendicular to the stern of the marine vessel and propels the marine vessel straight ahead). The end stop wheel positions in each rotational direction may also be maintained and not changed. In such an embodiment, adjusting the steering map thus includes adjusting the drive angles correlated with wheel positions between the existing center wheel position and each of the existing, unchanged, end stop wheel positions. This is different than the shifted steering map described above, where the wheel position that is correlated with the centered drive position changes. However, in embodiments where the steering map is adjusted, or expanded, to accommodate the changed maximum drive angle and permitted drive angle range, situations may still occur where the steering wheel is turned beyond the end stop position. Thus, the above-described problem of unresponsiveness may still arise and when it does the steering map may be shifted as described above to enable responsive steering even in situations where the operator turns the wheel significantly past the end stop position, whether it be the original, unchanged, end stop position or the adjusted end stop position described above.

FIG. 1 illustrates a steering system 10 for steering a plurality of marine drives 14*a* and 14*b* on a marine vessel 12. The marine drives 14*a*, 14*b* shown are outboard motors; however, the marine drives could instead be inboard motors, stern drives, pod drives, outboard motors having steerable gearcases (such as disclosed in U.S. patent application Ser. No. 16/171,490, for example) and/or jet drives, or any other devices that are steerable and configured to propel a marine vessel. Each marine drive 14*a*, 14*b* includes a powerhead 16*a* or 16*b*. The powerheads 16*a*, 16*b* shown here may be internal combustion engines, for example, gasoline or diesel engines, electric motors, and/or a hybrid thereof. Each marine drive 14*a*, 14*b* in the present example also includes a propeller 18*a* or 18*b* configured to be coupled in torque-transmitting relationship with a respective powerhead 16*a* or 16*b*.

The marine drives 14*a*, 14*b* further include powerhead speed sensors 22*a*, 22*b* measuring a rotational speed of a respective powerhead 16*a*, 16*b* (or an output shaft thereof). In one example, the powerhead speed sensors 22*a*, 22*b* may be shaft rotational speed sensors (e.g., Hall-Effect sensors), which measure a rotational speed of the powerhead 16*a* or 16*b* in rotations per minute (RPM), as is known to those having ordinary skill in the art.

A central control module 28 (or CCM) is provided in signal communication with the powerheads 16*a*, 16*b*, as well as being in signal communication with the associated sensors and other components noted hereinbelow. In certain examples, the central control module 28 communicates with propulsion control modules 29*a*, 29*b* (or PCMs) and/or other control devices associated with each of the marine drives 14*a*, 14*b* in a manner known in the art.

The steering system 10 further includes steering actuators 50*a*, 50*b* configured to rotate the marine drives 14*a*, 14*b*, respectively, in accordance with commands from a steering device as discussed further below. Each marine drive 14*a*, 14*b* is rotated about its respective steering axis SA (see FIGS. 3-5) to a drive angle, such as a drive angle commanded by an operator at a steering wheel 40. Exemplary steering actuators 50*a*, 50*b* are disclosed in U.S. Pat. Nos. 7,150,664; 7,255,616; and 7,467,595, which are incorporated by reference herein in their entireties. In certain examples, the steering actuators 50*a*, 50*b* are hydraulic steering actuators operating according to the principles described in the patents cited above. Other examples of steering actuators 50*a*, 50*b* include electric motors and pneumatic actuators.

Figure 2:
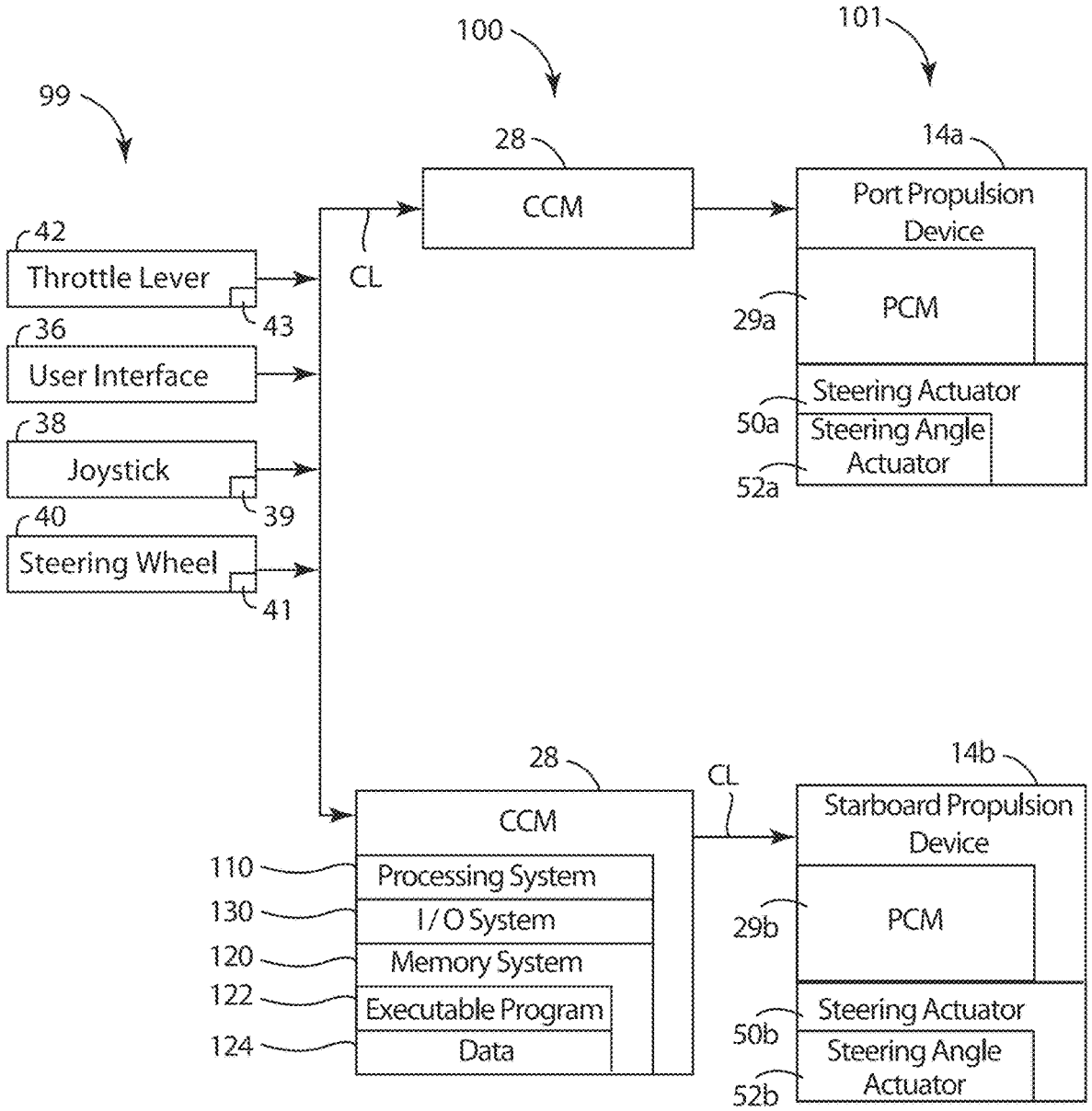
FIG. 2 is a schematic view of another exemplary marine steering system.

Subject to the control methods and improvements discussed herein, the central control module 28 and/or propulsion control modules 29 control steering for the marine drives 14*a*, 14*b* through control of the steering actuators 50*a*, 50*b* in a manner known in the art. In the example shown in FIG. 1, these steering actuators 50*a*, 50*b* are "steer-by-wire" systems, whereby the steering actuators 50*a*, 50*b* are controlled by electronic signals from the central control module 28 and/or propulsion control modules 29*a*, 29*b* rather than by physical linkages to such steering devices, such as a steering wheel 40. As shown in FIG. 2 and discussed further below, sensors 39, 41 associated with the steering devices detect the positions of these steering devices and provide electronic signals to the central control module 28 for subsequently steering the marine vessel 12 in a manner known in the art. Steering angle sensors 52*a*, 52*b* are also provided in conjunction with each steering actuator 50*a*, 50*b* to measure the steering angle of each marine drive 14*a*, 14*b* at any given time, also in a manner known in the art.

It will be recognized that the actual steering angle of each marine drive 14*a*, 14*b* may be inferred based on the position of the steering actuators 50*a*, 50*b*, for example whereby the steering angle sensors 52*a*, 52*b* are encoders associated with the steering actuators 50*a*, 50*b*. In the embodiment shown in FIG. 1, each marine drive 14*a*, 14*b* is independently steerable via the corresponding steering actuators 50*a*, 50*b* with no connection to marine drives, for example, connections via tie-bars.

An exemplary steering system 10 and control system 100 therefore are diagrammatically shown in FIG. 2. In the example shown, the central control module 28 includes a processing system 110, which may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices. A person of ordinary skill in the art will recognize that these subsystems may also be present within additional central control modules 28 (as applicable), and/or propulsion control modules 29*a*, 29*b* or other controllers within the marine vessel 12. In the example shown, multiple control modules are communicatively connected and/or cooperate together to form the control system 100, including a central control module (CCM) 28, one or more propulsion control modules (PCMs) each associated with a marine drive 14*a*, 14*b*, and/or other controllers such as engine or motor controllers, etc. However, additional and/or different controllers in alternate configurations may also be considered to be part of the control system 100.

The central control module 28 further includes a memory system 120, which may comprise any storage media readable by the processing system 110 and capable of storing the executable program 122 and/or data 124, such as software configured to execute the control methods and the steering maps described herein. The memory system 120 may be implemented as a single storage device or may be distributed across multiple storage devices or sub-systems that cooperate to store computer readable instructions, data structures, program modules, or other data. The memory system 120 may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output (I/O) system 130 provides communication between the control system 100 and peripheral devices, such as input devices 99 and output devices 101, which are discussed further below. In practice, the processing system 110 loads and executes an executable program 122 from the memory system 120, accesses data 124 stored within the memory system 120, and directs the steering system 10 to operate as described in further detail below.

A person of ordinary skill in the art will recognize that these subsystems within the control system 100 may be implemented in hardware and/or software that carries out a programmed set of instructions. As used herein, the term "controller" or "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. As shown in FIG. 2, one or more central control module 28 may together constitute a control system 100.

A person of ordinary skill in the art will understand in light of the disclosure that the control system 100 may include a differing set of one or more control modules, or control devices, which may include engine control modules (ECMs) for each marine drive 14*a*, 14*b* (which will be referred to as ECMs even if the marine drive 14*a*, 14*b* contains an electric motor in addition to or in place of an internal combustion engine), one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 100, and/or each of the control modules therein, communicates with each of one or more components on the marine vessel 12 via a communication link CL, which can be any wired or wireless link. The illustrated communication link CL connections between functional and logical block components are merely exemplary, which may be direct or indirect, and may follow alternate pathways. The control system 100 is capable of receiving information and/or controlling one or more operational characteristics of the steering system 10 and its various sub-systems by sending and receiving control signals via the communication links CL. In one example, the communication link CL is a controller area network (CAN) bus, such as a CAN Kingdom network; however, other types of links could be used which may utilize wired or wireless communication means. It will be recognized that the extent of connections and the communication links CL may in fact be one or more shared connections, or links, among some or all of the components in the marine vessel 12. Moreover, the communication link CL lines are meant only to demonstrate that the various control elements are capable of communicating with one another, and do not represent actual wiring connections between the various elements, nor do they represent the only paths of communication between the elements. Additionally, the marine vessel 12 may incorporate various types of communication devices and systems, and thus the illustrated communication links CL may in fact represent various types of wireless and/or wired data communication systems.

As will be discussed further below, the control system 100 communicates with input devices 99 from various components such as steering devices, for example via sensors 39, 41 that detect the positions of a joystick 38, steering wheel 40, respectively. The wheel position sensor 41, for example, senses and measures a rotational position of the steering wheel 40 so that the marine drives can be rotated, or steered, accordingly. The control system 100 also communicates with other operator input devices, such as the throttle lever 42 via its sensor 43, or a user interface 36, for example by setting a route or destination using the GPS 30 or other systems discussed below. The control system 100 also communicates with output devices 101 such as steering actuators 50*a*, 50*b*, for example. It will be recognized that the arrows shown are merely exemplary and that communication may flow in multiple directions. For example, the steering angle sensors 52*a*, 52*b* and trim angle sensors 56*a*, 56*b*, while shown as corresponding to the steering actuators 50*a*, 50*b* and trim actuators may serve as input devices 99 feeding into the one or more controllers 28.

Returning to FIG. 1, the marine vessel 12 also includes a global positioning system (GPS) 30 that provides location and speed of the marine vessel 12 to the central control module 28. Additionally or alternatively, a vessel speed sensor such as a Pitot tube or a paddle wheel could be provided. The marine vessel 12 may also include an inertial measurement unit (IMU) or an attitude and heading reference system (AHRS) 26. An IMU has a solid state, rate gyro electronic compass that indicates the vessel heading and solid-state accelerometers and angular rate sensors that sense the vessel's attitude and rate of turn. An AHRS provides 3D orientation of the marine vessel 12 by integrating gyroscopic measurements, accelerometer data, and magnetometer data. The IMU/AHRS could be GPS-enabled, in which case a separate GPS 30 would not be required.

As discussed above, the marine vessel 12 includes a number of operator input devices located at the helm 32 of the marine vessel 12. The operator input devices include a multi-functional display device 34 including a user interface 36. The user interface 36 may be an interactive, touch-capable display screen, a keypad, a display screen and keypad combination, a trackball and display screen combination, or any other type of user interface known to those having ordinary skill in the art for communicating with a multi-functional display device 34. The operator input devices further include one or more steering devices, such as a steering wheel 40 and/or a joystick 38, configured to facilitate user input to control the steering system 10, and thus to steer the vessel 12. In the embodiment shown, a joystick 38 provided at the helm 32 allows an operator of the marine vessel 12 to command the marine vessel 12 to translate or rotate in any number of directions. A steering wheel 40 is provided for providing steering commands to the marine drives 14*a*, 14*b*. A throttle lever 42 is also provided for providing thrust commands, including both a magnitude and a direction of thrust, to the central control module 28. Here, two throttle levers are shown, each of which can be used to control one of the marine drives 14*a* or 14*b*, although the two levers can be controlled together as a single lever. Alternatively, a single lever could be provided for controlling both marine drives 14*a*, 14*b*.

Figure 6A:
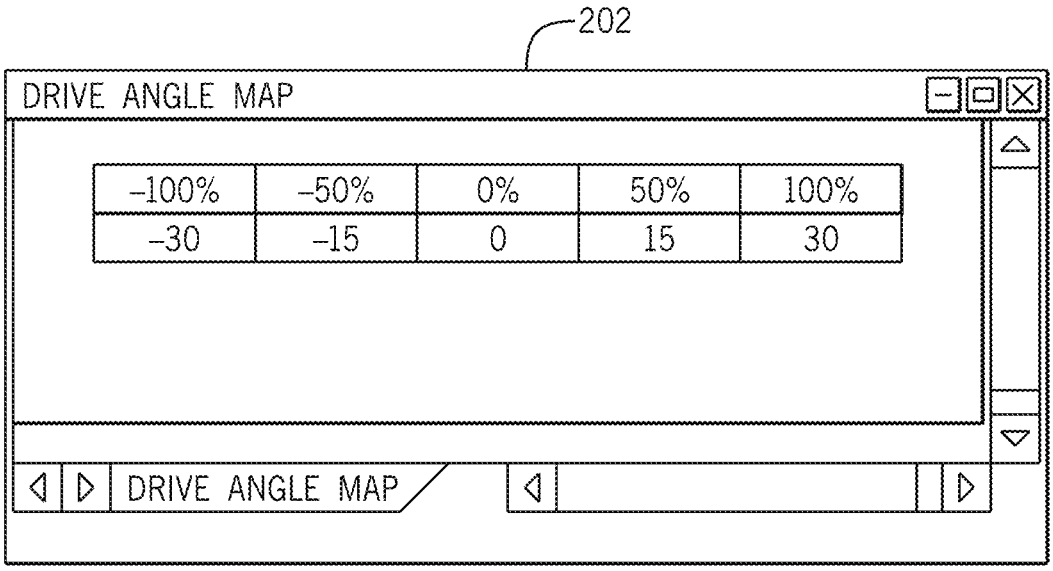
FIGS. 6A and 6B illustrate exemplary steering maps correlating wheel position to drive angles in accordance with embodiments of the present disclosure.
Figure 6B:
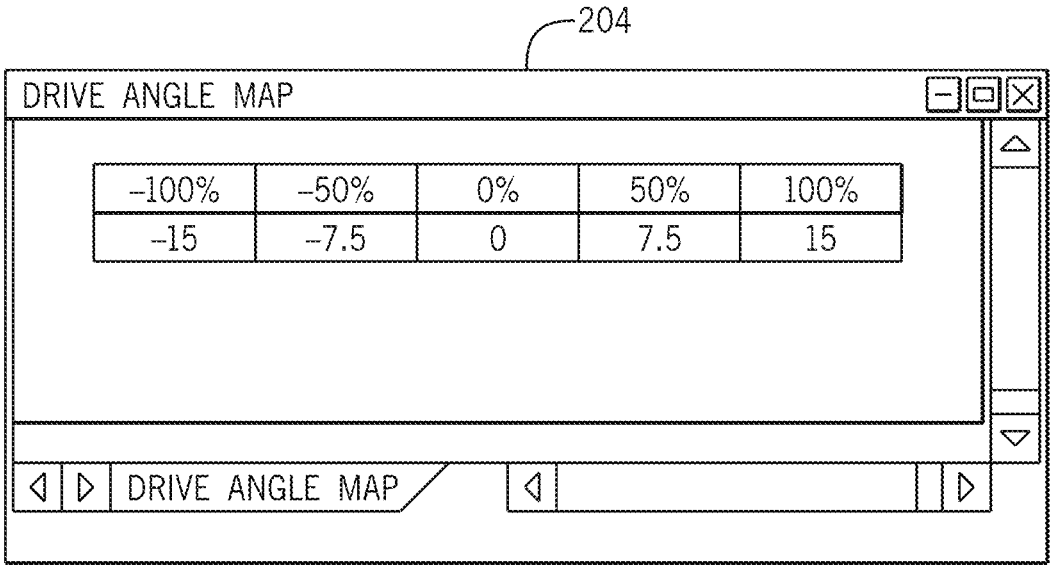

Several of the operator input devices at the helm 32 can be used to input an operator command for the powerheads 16*a*, 16*b* to the central control module 28, including the user interface 36 of the multi-functional display device 34, the joystick 38, and the throttle lever 42. For example, steering control commands inputted by an operator by rotating the steering wheel 40 may be correlated to drive angles for controlling drive position by the steering actuators 50*a*, 50*b*. In one example, whereby operator inputs translated into a position within a range of −100% to +100% corresponding to full port and full starboard steering directions, which then causes corresponding steering of the marine drives 14*a*, 14*b*, in certain examples through the use of a lookup table. Exemplary steering maps providing such correlation for steering control are illustrated at FIGS. 6A and 6B and are discussed below.

As described above, the present inventors have recognized situations may arise requiring that a permitted drive angle range, including a maximum drive angle in each rotational direction, may need to be adjusted while the vessel is underway and being navigated by an operator via a steering wheel and/or while the vessel is being controlled by an automatic steering control system (e.g., an autoheading or waypoint following system). For example, problems arise relating to steering multiple marine drives that are not connected via tie-bars or other physical linkages, such as problems with drive collisions between adjacent drives. In current systems, drive angles are typically confined to a fixed angle range that is continually and always applied to contain the drive angles between predetermined and fixed maximum drive angles in each direction. However, the inventors have recognized that fixed drive angle ranges are not ideal for all marine propulsion systems, and particularly for systems with a plurality of marine drives mounted closely together in a steer-by-wire arrangement where no tie bars or other physical linkages are used between drives. For instance, situations arise where one a marine drive is deactivated or otherwise is not steered. The deactivated marine drive is stationary while the other drives continue to be steered. For instance, when a given marine drive is not operating, meaning power is not being generated by the corresponding alternator, the steering systems for any such non-operating marine drive are customarily deactivated so as to not deplete the stored energy in the battery. In other words, deactivated steering actuators 50*a*, 50*b* are not presently steerable, despite continuing to receive user inputs to steer, for example.

In contrast, steering systems for marine drives that are presently capable of steering may be referred to as "activated." It will be recognized that steering systems may thus be deactivated for multiple reasons, including the corresponding marine drives being "key-off", hardware faults that do not permit steering, and/or software or networking faults that do not permit steering, for example. The steering systems for the marine drive can thus be activated or reactivated by turning the corresponding marine drive's key to the on position, and/or resolving the faults described in the previous example. As such, the occurrence of one of the aforementioned actions thereby serve as a request to the central control module 28 to activate steering for the marine drive in which steering was previously deactivated.

Deactivated marine drives still have an impact on overall steering, specifically as static rudders. Moreover, the deactivated drives can cause a drive collision hazard which should be avoided, such as by narrowing the permitted drive angles of the surrounding activated marine drives. In view of this, alternative measures are necessary for controlling the steering angles of marine drives such that collisions between adjacent marine drives do not occur when one or more of the marine drives become deactivated (for example, collisions between the propellers and/or gearcases of adjacent marine drives). Limitations to the steering angles for steerable marine drives may be incorporated into the software in a control system, for example, such as through reference of a lookup table or algorithm. As discussed further below, the marine drives may be deactivated from a steering perspective due to being keyed off, and/or deactivated due to some fault condition (e.g., electrical, mechanical, or both).

The degree to which a non-steering marine drive impacts the steering of the other operable or steerable marine drives, and thus the amount that a permitted drive angle range is narrowed, may depend in part upon the steering angle of the non-steerable marine drive when it becomes disabled. The changed permitted drive angle range may further depend on and be calibrated for fixed factors, such as the mounting distance between the marine drives, the size of the marine drives, the length of the propellers, etc. For example, a marine drive that becomes disabled with a steering angle corresponding to driving the marine vessel dead ahead (a zero degree steering angle) may be less limiting on adjacent marine drives than if the non-steerable marine drive were disabled when steering at a maximum steering angle, such as a 30 degree steering angle, for example.

Figure 3:
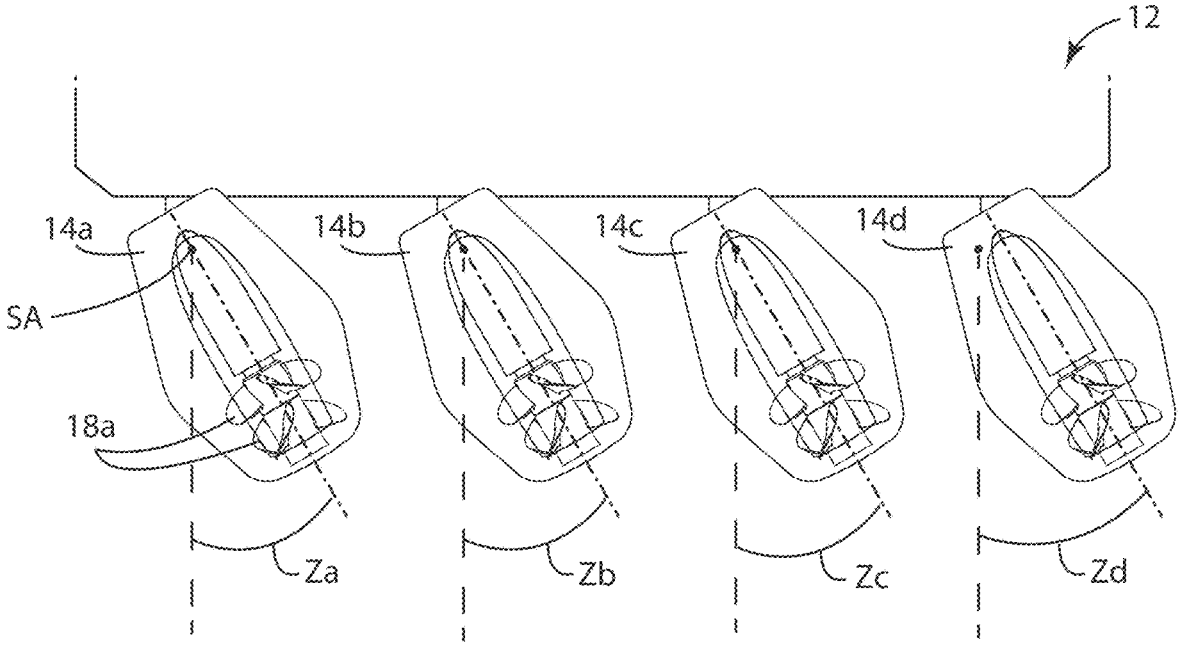
FIG. 3 is a partial top view of a marine vessel having four marine drives operated according to the present disclosure, with all four marine drives illustrating a maximum drive angle.

FIG. 3 depicts a view of a marine vessel 12 having four marine drives 14*a*-14*d* each steerable about a respective steering axis SA, which in the present case are all shown to be positioned at drive angle Za-Zd corresponding to steering the marine vessel 12 in a starboard direction. All four of the marine drives 14*a*-14*d* are shown in a maximum drive angle Za-Zd of +30 degrees. The corresponding drive angle range is ±30 degrees of a centered drive position where the marine drive 14 is oriented to propel the vessel 12 straight ahead, which is described further below.

Figure 4:
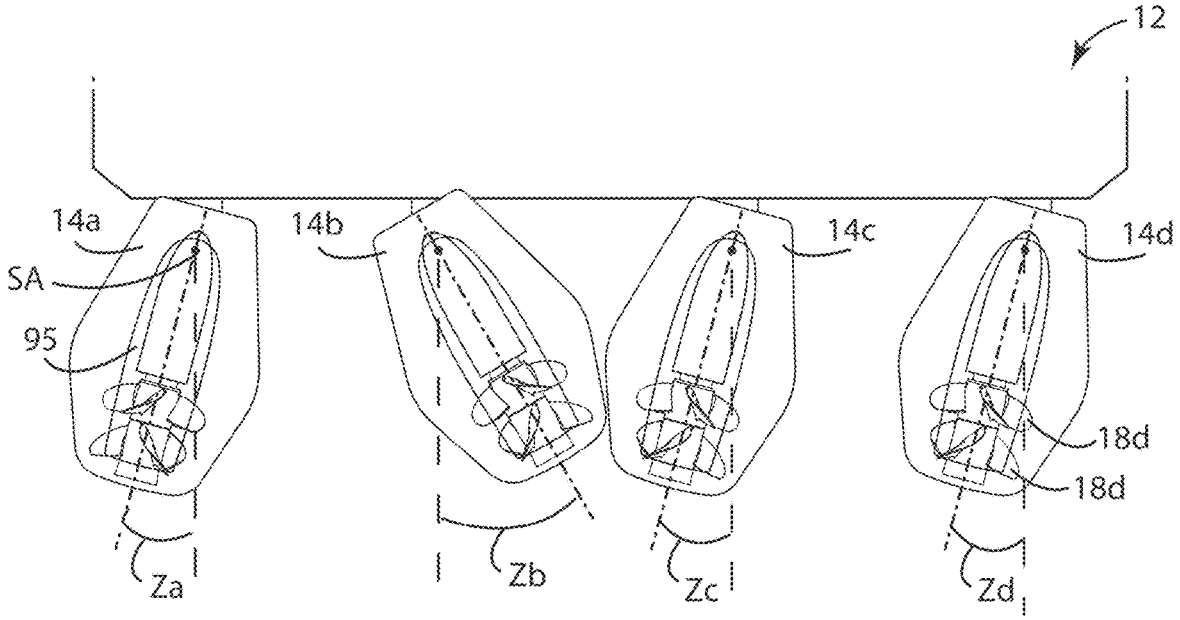
FIG. 4 is a top view of a configuration similar to FIG. 3, but wherein the second marine drive has been deactivated requiring a narrowed permitted drive angle range.

In a hypothetical example, the second marine drive 14*b* is then deactivated such that it is no longer steerable, for example by the operator keying off the second marine drive 14*b*. As shown in FIG. 4, this results in the second marine drive 14*b* remaining at a fixed drive angle Zb of the same +30 degrees shown above in FIG. 3, despite the other marine drives 14*a*, 14*c*-14*d* continuing to be steered by the operator as shown steering to port in FIG. 4. Thus, a narrowed permitted drive angle is required to avoid drive collision between drive 14*b* and either one of drives 14*a* and 14*c*. As shown in FIG. 4, the drive angles Za, Zc-Zd of the marine drives 14*a*, 14*c*-14*d* are now limited or restricted to a narrowed permitted drive angle range as defined by a restricted, or changed, maximum drive angle in each direction to prevent a collision with the marine drive having deactivated steering. In the present example, when steering for the second marine drive 14*b* is deactivated, the permitted drive angle ranges Za, Zc-Zd for the remaining marine drives 14*a*, 14*c*-14*d* is narrowed such that the drives cannot be rotated past a changed, or reduced, maximum drive angle so as to prevent a collision between adjacent marine drives.

In the example of FIG. 4, the predetermined restriction angle for the marine drives 14*a*, 14*c*-14*d* is ±15 degrees, symmetrical about the centered drive position. Therefore, the central control module 28 will restrict steering of these marine drives 14*a*, 14*c*-14*d* to not exceed drive angles of ±15 degrees even if a steering request greater than this restricted angle is received from one of the steering devices. It will be recognized that these restrictions on the drive angles Za, Zc-Zd may always be limited to a fixed maximum drive angle, such as 15 degrees, or may be variable depending upon the drive angle and/or trim angle of the non-steerable or deactivated marine drive. For example, the limitation on the drive angle Zc of the third marine drive 14*c* may depend upon the drive angle Zb of the deactivated second marine drive 14*b*.

Moreover, the steerable marine drives 14*a*, 14*c*-*d* may be bound by the same narrowed permitted drive angle range, for example ±15 degrees as discussed above and shown in FIG. 4, or have differing permitted ranges depending upon their individual possibilities for collision. For example, in the example shown in FIG. 4, the first marine drive 14*a* and fourth marine drive 14*d* may be permitted to steer at greater drive angles Za, Zd than the third marine drive 14*c* in recognition that the only opportunity for collision is with respect to a second marine drive 14*b*, which is fixed in an angle away from the first marine drive 14*a*. Moreover, in some embodiments the narrowed permitted drive angle range for one or more of the marine drives may be asymmetrical about the centered steering position, such as for an outer drive (e.g., 14*a* and 14*d*) where the collision risk is only in one direction.

The resistance device 27 is controlled to apply the resistance force to oppose rotation of the steering wheel 40 past the end stop position, whether that be at ±100% or at an adjusted end stop wheel position at a lesser wheel position, such as at ±50%. In some embodiments, the resistance force may not be enough to prevent an operator from turning the steering wheel past the end stop position when the operator applies significant force to turn the wheel. In such embodiments, the system 10 may be configured to continue to apply the resistance force against rotation of the steering wheel 40 in a rotational direction past the adjusted end stop position, which will be referred to here as a first rotational direction. The resistance force is continually applied, (such as to apply a maximum resistance that the resistance device is capable of, against rotation in the first rotational direction while the wheel position remains past the end stop position. Meanwhile, the drive angle of the at least one marine drive is maintained at the maximum drive angle such that the drive angle stays within the narrowed permitted drive angle range. Once the steering wheel 40 is turned past the end stop, and thus the drive(s) 16 are not moved correspondingly because they are at the maximum drive angle, a situation is created where the steering map (e.g., 202 or 204) does not apply. Continuing operation without changing the steering map creates a situation where the steering system 10 is unresponsive to the operator inputs at the steering wheel 40. Details relating to this problematic scenario are discussed above.

The current system addresses this problem by shifting the steering map to correlate a current measured wheel position with a drive angle that is within the permitted drive angle range. For example, when the steering wheel is turned past the end stop position and then is rotated in an opposite direction back toward the end stop position, the steering map is shifted accordingly such that the steering system is made immediately responsive to move the marine drives in response to the steering wheel rotation. For example, the steering map may be shifted by an amount equal to the furthest steering wheel position past the end stop position. In other words, the wheel position correlated with the centered drive position, and likewise the maximum wheel position correlated with the maximum drive angle and every position therebetween, will be shifted by the amount that the steering wheel 40 was turned past the end stop position (or the adjusted end stop position, as the case may be).

Figure 5:
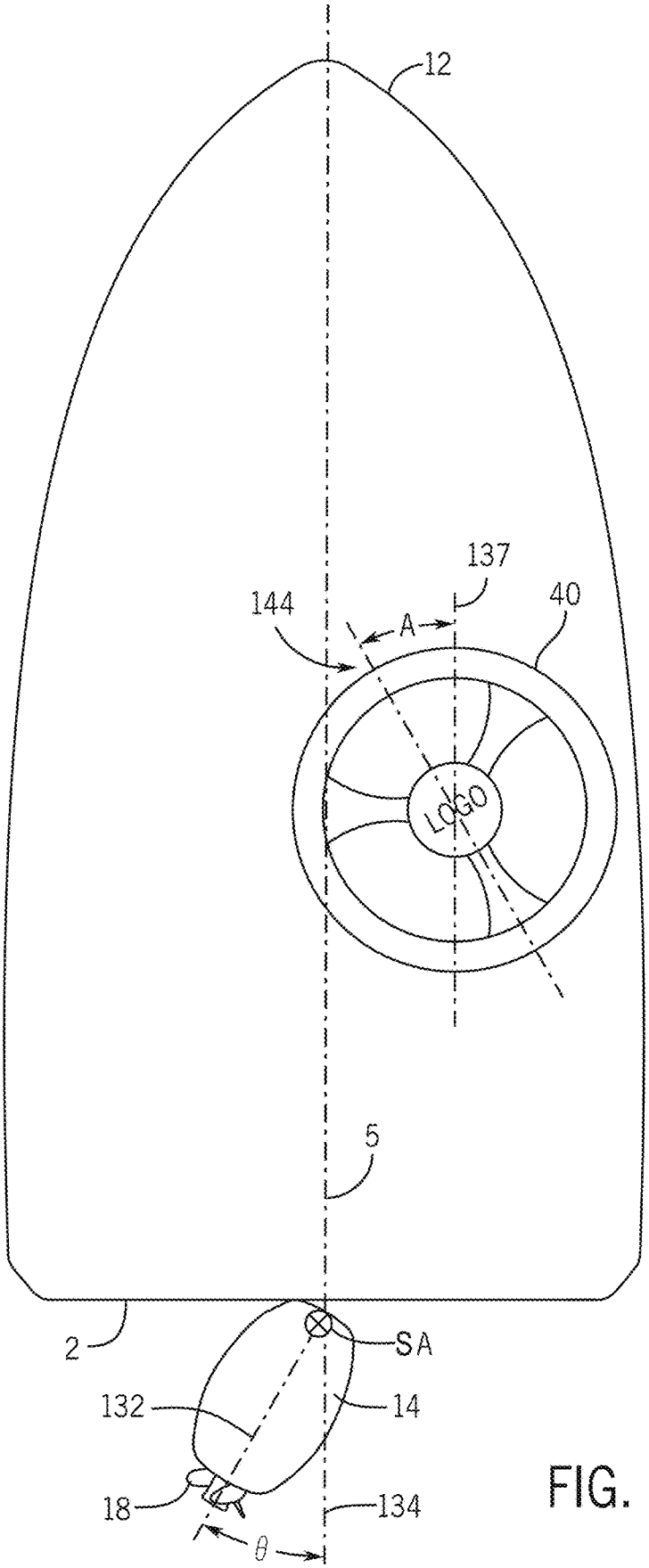
FIG. 5 is a schematic illustration of a steering wheel position and drive angle correlation.

FIG. 5 illustrates a steering wheel arrangement where a wheel position A of the steering wheel 40 is correlated to a drive angle θ of the marine drive 14. The drive angle θ is measured between a center axis 132 of the marine drive 14 and the centered drive angle, or centered drive position, represented by line 134 which is perpendicular to the stern 2 of the marine vessel 12. In embodiments where only one marine drive is provided, the centered drive position and the center position line 134 may align with the centerline 5 of the marine vessel. The figure illustrates the wheel position A as an angle with respect to a center wheel position where the axis 144 of the steering wheel is aligned with the centered position 137. When the axis 144 is aligned with the centered position 137, the steering wheel 40 is in the center wheel position associated with the measurement position, or measurement axis, 137—i.e., A=0 and θ=0. In various embodiments, the center wheel position can be adjusted, such as by adjusting the position correlated with axis 144 to change the output, or measured relative position, of the steering wheel, as described herein.

In certain systems presently known in the art, the steering wheel 40 position or other steering device position is represented as a steering percentage at the central control module 28 to steer the marine drives 14*a*-14*d* based on the location of the steering device relative to its assigned center position, which is the wheel position correlated with the centered drive position. The steering percentage may be determined based on a measured rotational position by the steering wheel position sensor 41. In some examples, this value may be defined as being between −100% and +100% corresponding to steering all the way to port and all the way to starboard, respectively. The central control module 28 then translates this input to changes in the drive angles of the marine drives within the permitted drive angle range. In other words, a −100% steering position corresponds to a maximum drive angle to steer the marine vessel toward the port direction (e.g., a −30 degree drive angle) and +100% steering position may correspond to a maximum drive angle in the opposite direction to steer the marine vessel toward the starboard direction (e.g., a +30 degree drive angle).

At the point where the steering wheel 40 has reached the maximum rotational position, either the −100% position or the +100% position, an end stop is applied to stop the rotation of the steering wheel, or at least to alert a user that the end position has been reached by resisting rotation in the direction beyond the 100% position. In steer-by-wire systems, these end stops are digitally set and activated by a resistance device 27 controllable to apply a braking force on the steering wheel to prevent or discourage turning the wheel past the point of the end stop. The resistance device 27 is operable to apply a resistance force to resist rotation of the steering wheel 40, such as by applying the resistance force to a steering column to which the steering wheel is attached.

The resistance device 27 is controllable to effectuate the end stop, and thus to resist rotational movement of the steering wheel once the maximum steering position, or ±100% steering position, is reached. The type of resistance device 27 can vary and can include any type of electrical, mechanical, or hydraulic device that is operable to restrict and/or brake against rotational movement of the steering wheel 40 based upon commands from a controller and/or the control system 100. For example, the resistance device 27 may include a magnetorheological fluid (MRF) braking mechanism configured and controllable to apply a variable braking force on the steering column to resist rotation of the steering wheel. In another example, the resistance device 27 may include an electric motor and/or a hydraulic pump that powers a mechanical clamp or other similar device that engages with the steering column attached to the steering wheel 40 and applies a variable resistance force on the steering column to restrict, resist, or brake its rotation. In still other embodiments, the resistance device 27 may include a DC motor directly coupled to the steering column or otherwise configured to apply a braking or counter-rotational force on the steering wheel. In still other embodiments, the resistance device 27 may be a clutch brake mechanism attached to the steering column and controlled via a solenoid.

In typical use, the control system 100 steers the marine drives to meet these command targets to a normal operating drive angle range of between −30 and +30 degrees, which is just one exemplary fully expanded drive angle range. However, as discussed above, there are instances where the permitted drive angle range must be narrowed, such as to prevent adjacent drives from colliding with one another. In such embodiments, the steering is adjusted to accommodate the narrowed drive angle range and facilitate smooth and seamless steering control of the marine vessel 12 via the steering wheel 40. In one embodiment, one or more of the end stops are adjusted to apply a braking force against steering wheel rotation once the steering wheel 40 reaches a steering wheel position associated with the maximum drive angle. In another embodiment, the steering map may be adjusted to correlate the narrowed permitted drive angle range to the existing steering position range—i.e., to remap the wheel positions between +100% to the narrowed permitted drive angle range.

FIG. 6A provides an exemplary steering map 202 correlating wheel positions of a steering wheel between +100% and −100% to drive angles of a marine drive within a permitted drive angle range of +30 degrees and −30 degrees. This may exemplify, in one embodiment, an expanded permitted drive angle range that is a maximum for the marine vessel and is utilized during most operating conditions. Under normal operating conditions, the end stop position is set at the +100% wheel positions. Thus, when the steering wheel reaches either the −100% position or the +100% position, the resistance device is controlled to apply a braking force. In embodiments where a narrowed permitted drive angle range is effectuated by adjusting an end stop wheel position, then the braking force may be applied at a different wheel position, such as a different wheel percent position. In an example where the narrowed permitted drive angle range is ±15 degrees from the center steering position (instead of the ±30 degrees), then the adjusted end stop wheel position may be at 50%, which is the steering position associated with the changed, or narrowed, maximum drive angle of ±15 degrees. In such an embodiment, when the steering wheel 40 reaches either the +50% wheel position-50% wheel position, then the resistance device is controlled to apply a resistance force against rotation of the steering wheel past the adjusted end stop position. In such an embodiment, the association between wheel position and drive angle provided by the steering map 202 is not changed, but the location at which the end stop wheel position is effectuated by the resistance device is changed.

FIG. 6B provides one example to illustrate an embodiment where the change in permitted drive angle range is accounted for at the steering wheel by adjusting a steering map correlating the wheel positions of the steering wheel 40 to the drive angles within the changed permitted drive angle range. The adjusted steering map 204 illustrated in FIG. 6B remaps the narrowed permitted drive angle range of ±15 degrees across the full range of wheel positions between ±100%. For example, the 100% steering position is associated with a maximum drive angle of +15 degrees and all steering positions between 0 and 100% are remapped accordingly. For example, the ±50 degree steering positions get correlated with ±7.5 degree drive angles. The center wheel position (0%) is correlated with a centered drive position (0 drive angle), which remains unchanged between the normal steering map (e.g., map 202) and the adjusted steering map 204. The end stop wheel positions for each of the clockwise and counterclockwise rotational directions also are maintained and unchanged between the normal steering map 202 and the adjusted steering map 204.

Figure 7:
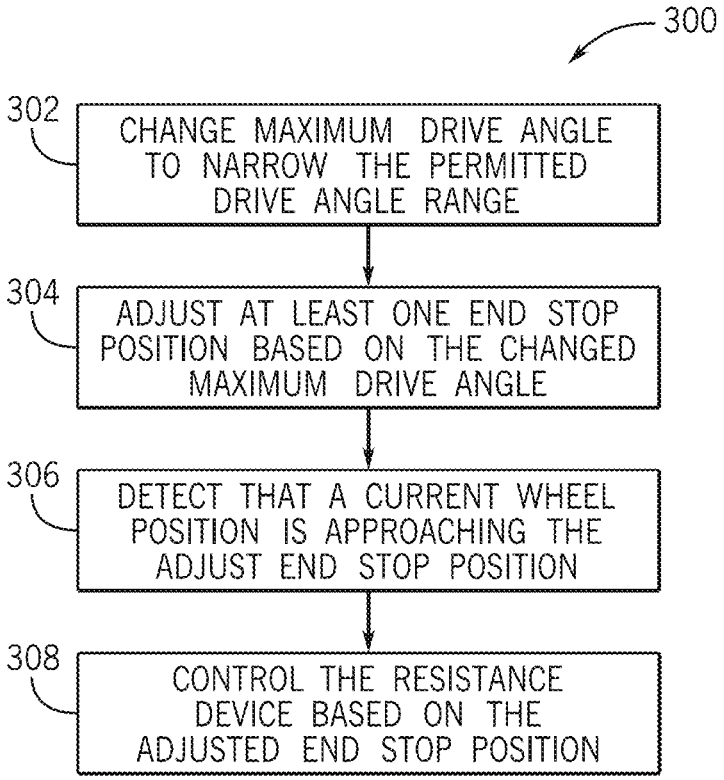
FIGS. 7-9 are flow charts illustrating methods of operating a steering system on a marine vessel according to embodiments of the present disclosure.
Figure 8:
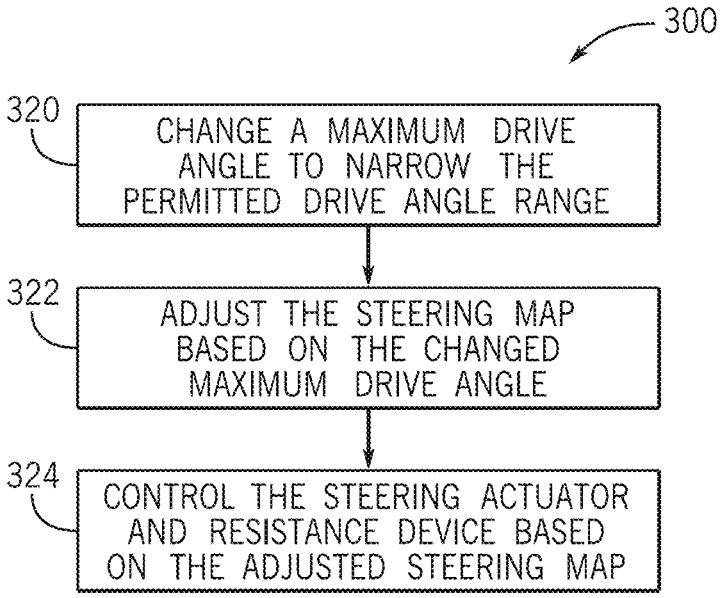
Figure 9:
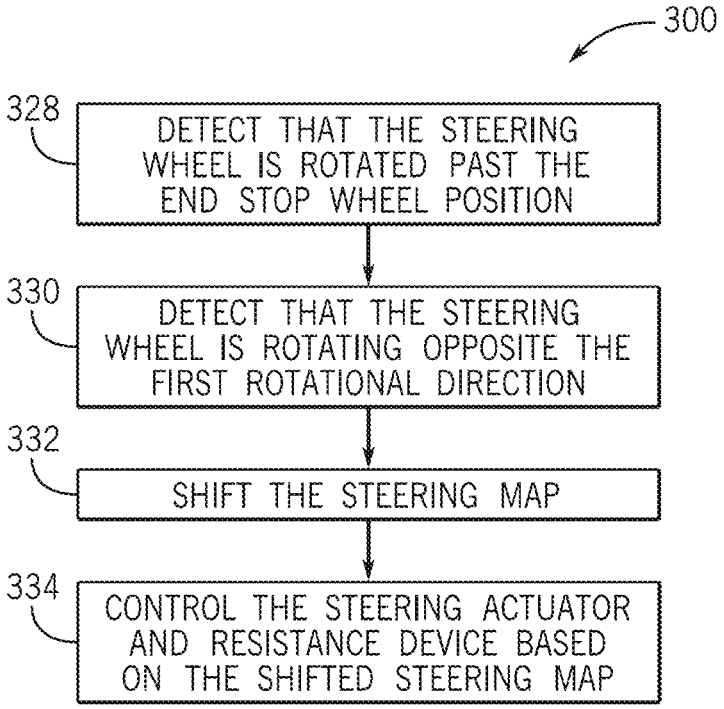

FIGS. 7-9 illustrate embodiments of methods of operating a steering system 10 on a marine vessel. FIG. 7 illustrates one embodiment of a method 300 of operating a steering system where end stop adjustments are made based on a change in the maximum drive angle and the permitted drive angle range. A change in the maximum drive angle is made at step 302 to narrow the permitted drive angle range. At least one end stop position is adjusted at step 304 based on the changed maximum drive angle. In one embodiment, where the maximum drive angle in both rotational directions is narrowed symmetrically about the centered drive position (drive angle=0), the end stops are adjusted symmetrically about the center steering wheel position and proportionally with the change in the permitted drive angle range such that the end stops correlate with the maximum drive angle in each rotational direction.

At step 306, it is detected that the current wheel position is approaching the adjusted end stop position. For example, detection that the current wheel position of the steering wheel 40 is approaching the adjusted end stop wheel position may include determining that the current measured wheel position measured by the wheel position sensor 41 is within a predetermined distance or angle of the adjusted end stop position and that the steering wheel is moving in a rotational direction toward the end stop wheel position. Detection of the end stop occurs at or before the current wheel position reaches the end stop position. The resistance device 27 is then controlled at step 308 based on the adjusted end stop position. Thus, the resistance device 27 can be activated and the braking force applied, for example to apply a maximum resistance force within the capabilities of the resistance device 27, at or before the moment when the steering wheel 40 reaches the end stop wheel position.

FIG. 8 depicts another embodiment of a method 300 of operating a steering system on a marine vessel that includes adjusting the steering map based on the changed maximum drive angle and permitted drive angle range. When the maximum drive angle is changed at step 320 to narrow the permitted drive angle range, the steering map is adjusted at step 322 based on the changed maximum drive angle and permitted drive angle range. For example, the narrowed permitted drive angle range may be spread out across the full range of wheel positions between ±100%. Thus, the end stop positions become associated with the changed maximum drive angles. The steering actuator 50 and the resistance device 27 are then controlled based on the adjusted steering angle map at step 324.

FIG. 9 depicts another embodiment of a method 300 of operating a steering system, or a portion of such method 300, where correction is made to maintain a responsive steering system once the steering wheel is rotated past the end stop position. Once it is detected at step 328 that the steering wheel 40 is rotated past the end stop position, resistance force is applied against rotation of the steering wheel in the first rotational direction past the adjusted end stop position, as described above. This discourages further turning the wheel past the end stop position. However, situations may arise where the steering wheel is moved significantly past the end stop wheel position. Once the operator starts rotating the wheel opposite the first rotational direction at step 330, and thus back toward the existing end stop position, whether it be the adjusted end stop position or the original end stop wheel position, action is taken to provide a steering response at the marine drive 14. The steering map is shifted at step 332 such that the current wheel position (e.g., the wheel position after the operator started rotating the steering wheel 40 in the opposite direction), is correlated to a drive position within the permitted drive angle range. Thus, a steering response can be provided to change the drive the angle response to the steering input. For example, the steering map may be shifted by an amount that the steering wheel was rotated past the end stop position. The steering actuator 50 is then controlled at step 334 based on the shifted steering map. Likewise, the resistance device is also controlled based on the shifted steering map as the wheel positions assigned as the end stop wheel positions are also shifted, such as by the amount that the steering wheel was rotated past the end stop position.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of operating a steering system for a marine vessel comprising at least one marine drive, the method comprising:

controlling a resistance device to apply a resistance force against rotation of a steering wheel in a first rotational direction past an end stop position;

controlling a steering actuator associated with a marine drive based on a steering map and such that a drive angle of the marine drive stays within a permitted drive angle range; and determining that a current wheel position has passed the end stop position and then adjusting control of the steering actuator to account for the current wheel position being past the end stop position.

2. The method of claim 1, wherein adjusting control of the steering actuator to account for the current wheel position being past the end stop position includes:

maintaining the drive angle of the at least one marine drive at a maximum drive angle while the steering wheel is moved in the first rotational direction; and controlling the resistance device to apply a maximum resistance against rotation of the steering wheel in the first rotational direction.

3. The method of claim 1, wherein adjusting control of the steering actuator to account for the current wheel position being past the end stop position includes shifting the steering map.

4. The method of claim 3, wherein shifting the steering map includes changing a wheel position that is correlated to a centered drive position.

5. The method of claim 3, wherein shifting the steering map includes changing a wheel position correlated to a maximum drive angle in the permitted drive angle range.

6. The method of claim 5, wherein shifting the steering map includes changing the wheel position correlated to the maximum drive angle by an amount that the steering wheel was rotated past the end stop position.

7. The method of claim 3, further comprising controlling the steering actuator based on the shifted steering map and such that the drive angle of the marine drive stays within the permitted drive angle range.

8. The method of claim 1, wherein adjusting control of the steering actuator to account for the current wheel position being past the end stop position includes expanding the steering map to include the current wheel position.

9. The method of claim 1, wherein adjusting control of the steering actuator to account for the current wheel position being past the end stop position includes determining that the steering wheel is rotating opposite the first rotational direction, and further comprising:

shifting the steering map to correlate the current wheel position with a drive position within the permitted drive angle range; and controlling the steering actuator based on the shifted steering map and such that the drive angle of the marine drive stays within the permitted drive angle range.

10. The method of claim 1, further comprising determining that the current wheel position is within a predetermined angle of the end stop position and that the steering wheel is moving in a rotational direction toward the end stop wheel position prior to controlling the resistance device to apply a resistance force against rotation of the steering wheel.

11. The method of claim 1, wherein controlling the resistance device to apply the resistance force against rotation of the steering wheel in a first rotational direction past the end stop position includes controlling the resistance device to apply a maximum resistance against rotation of the steering wheel in the first rotational direction when the steering wheel is at or past the end stop position.

12. The method of claim 11, further comprising controlling the resistance device to not apply resistance against rotation of the steering wheel opposite the first rotational direction.

13. A steering system configured for steering a marine vessel, the steering system comprising:

at least one marine drive;

at least one steering actuator configured to rotate the at least one marine drive about a vertical steering axis;

a steering wheel configured to be manually rotated by an operator to adjust a drive angle of the marine drive effectuated by the steering actuator;

a wheel position sensor configured to sense a current wheel position of the steering wheel;

a resistance device configured to apply a resistance force to resist rotation of the steering wheel;

a control system configured to:

control the resistance device to apply the resistance force against rotation of the steering wheel in a first rotational direction past an end stop position;

control the steering actuator associated with the marine drive based on a steering map and such that a drive angle of the marine drive stays within a permitted drive angle range; and determine that the current wheel position has passed the end stop position and then adjust control of the steering actuator to account for the current wheel position being past the end stop position.

14. The system of claim 13, wherein the control system is further configured to, in response to determining that the current wheel position has passed the end stop position:

maintain the drive angle of the at least one marine drive at a maximum drive angle in the permitted drive angle range while the steering wheel is moved in the first rotational direction; and control the resistance device to apply a maximum resistance against rotation of the steering wheel in the first rotational direction.

15. The system of claim 13, wherein the control system is further configured to adjust control of the steering actuator to account for the current wheel position being past the end stop position by shifting the steering map.

16. The system of claim 15, wherein shifting the steering map includes changing a wheel position that is correlated to a centered drive position.

17. The system of claim 15, wherein shifting the steering map includes changing a wheel position correlated to a maximum drive angle in the permitted drive angle range.

18. The system of claim 17, wherein shifting the steering map includes changing the wheel position correlated to the maximum drive angle by an amount that the steering wheel was rotated past the end stop position.

19. The system of claim 15, wherein the control system is further configured to control the steering actuator based on the shifted steering map and such that the drive angle of the marine drive stays within the permitted drive angle range.

20. The system of claim 13, wherein the control system is further configured to, in response to determining that the current wheel position has passed the end stop position:

determine that the steering wheel is rotating opposite the first rotational direction;

shift the steering map to correlate the current wheel position with a drive position within the permitted drive angle range; and control the steering actuator based on the shifted steering map and such that the drive angle of the marine drive stays within the permitted drive angle range.

* * * * *